US005632440A

United States Patent [19]

Tragardh et al.

[11] Patent Number: 5,632,440

[45] Date of Patent: May 27, 1997

[54] CONTAINER WITH PLUG-IN CLOSURE UNIT

[75] Inventors: Paul Tragardh, Formigine, Italy; Elmar Mock, Biel; Matthias Hell, Bern, both of Switzerland

[73] Assignee: Tetra Laval Holdings & Finance S.A., Pully, Switzerland

[21] Appl. No.: 437,715

[22] Filed: May 9, 1995

[30] Foreign Application Priority Data

Jun. 10, 1994 [CH] Switzerland ..... 01837/94

[51] Int. Cl.[6] ..... B65D 5/74

[52] U.S. Cl. ..... 229/125.15; 220/270; 220/339; 220/359; 229/123.2; 229/125.14

[58] Field of Search ..... 229/123.1, 123.2, 229/123.3, 125.09, 125.14, 125.15, 125.17, 125.42; 220/266, 270, 307, 339, 359

[56] References Cited

U.S. PATENT DOCUMENTS

| | | | |
|---|---|---|---|
| 2,560,776 | 7/1951 | Peters . | |
| 3,113,706 | 12/1963 | Wickman . | |
| 3,355,059 | 11/1967 | Balocca et al. | 229/123.2 |
| 3,883,034 | 5/1975 | Rausing | 229/123.3 |
| 3,998,354 | 12/1976 | Song | 220/307 |
| 4,391,385 | 7/1983 | Rausing | 220/270 |
| 4,393,979 | 7/1983 | Ball et al. | 220/270 |
| 4,526,287 | 7/1985 | Miyamatsu et al. | 220/359 |
| 4,595,116 | 6/1986 | Carlsson | 229/123.2 |
| 4,669,640 | 6/1987 | Ando et al. | 229/125.42 |
| 4,781,323 | 11/1988 | Elias et al. | 229/125.15 |
| 4,798,296 | 1/1989 | Lagerstedt et al. | 229/125.15 |
| 4,807,787 | 2/1989 | Langmeier et al. | 220/270 |
| 4,815,655 | 3/1989 | Jacobsson et al. | 229/125.15 |
| 4,930,683 | 6/1990 | Farber | 229/125.15 |
| 5,065,938 | 11/1991 | Anderson | 220/339 |
| 5,158,633 | 10/1992 | Rausing | 229/125.14 |
| 5,452,849 | 9/1995 | Schramer et al. | 229/125.09 |

FOREIGN PATENT DOCUMENTS

| | | | |
|---|---|---|---|
| 0 155 600 | 9/1985 | European Pat. Off. . | |
| 0291112 | 11/1988 | European Pat. Off. . | |
| 0407746 | 1/1991 | European Pat. Off. . | |
| 0 577 867 | 1/1994 | European Pat. Off. . | |
| 2659275 | 7/1978 | Germany | 229/125.42 |
| 1000214 | 8/1965 | United Kingdom . | |
| 91/12181 | 8/1991 | WIPO . | |

*Primary Examiner*—Gary E. Elkins
*Attorney, Agent, or Firm*—Spencer & Frank

[57] ABSTRACT

A combination of a container and a plug-in closure unit, and a method of manufacturing the container of the combination. The container has a wall having an opening therein defining an edge. The closure unit can be inserted into the opening, and further comprises a closure part including an opening lip defining an opening lip region, and a hinge disposed opposite the opening lip of the closure part and defining a hinge region. The closure unit also includes a pouring part connected to the closure part by the hinge. The pouring part includes a neck which can be inserted into the opening of the container, and a pouring opening. The pouring part further includes an inner retaining member extending beyond the edge of the opening on the interior of the container when the closure unit is inserted into the opening thereby defining an inner retaining plane C. The inner retaining member consists of a first inner retaining element to be disposed exclusively in the hinge region, and a second inner retaining member to be disposed exclusively in the opening lip region. The pouring part also includes an outer retaining member extending beyond the edge of the opening on the exterior of the container when the closure unit is inserted into the opening. The outer retaining member thereby defines an outer retaining plane C'. A portion of the wall of the container is retained between the inner and the outer retaining member between planes C and C'.

15 Claims, 5 Drawing Sheets

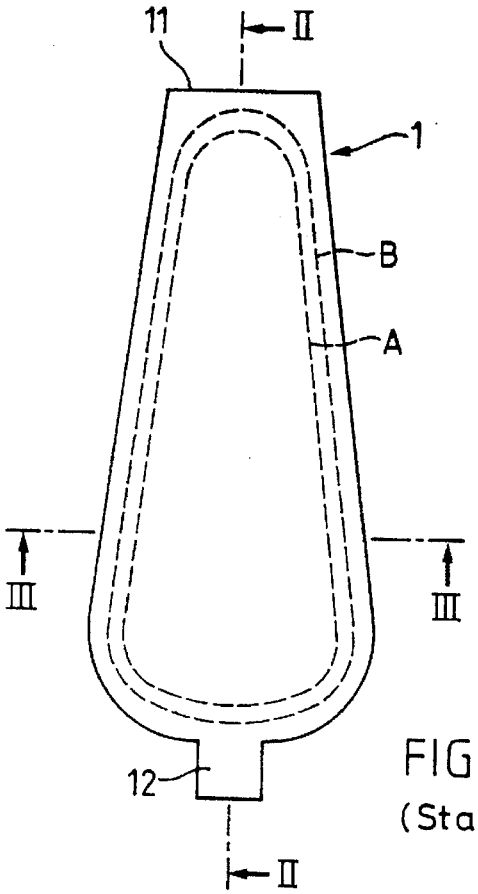
FIG. 1
(State of the art)
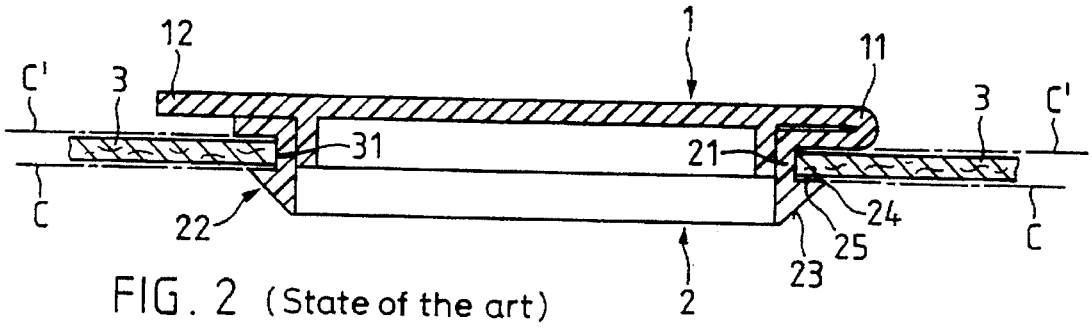
FIG. 2 (State of the art)
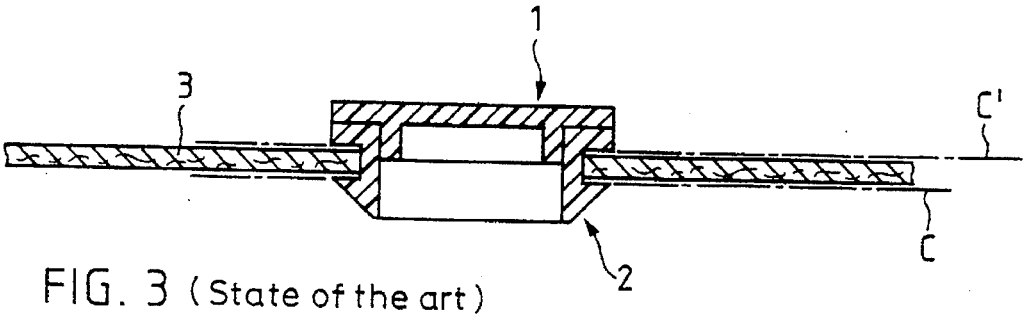
FIG. 3 (State of the art)

(State of the art)

CONTAINER WITH PLUG-IN CLOSURE UNIT

The invention is in the field of the packaging industry and relates to a combination consisting of a container and a plug-in closure unit insertable into a potential opening in the container wall. The invention also relates to the plug-in closure unit and the container with the potential opening as separate parts and to a method for manufacturing the container.

BACKGROUND OF THE INVENTION

For opening containers made of plastic coated cardboard and for pouring the contents out, usually either a seam of the container is opened or a corner torn off. In both cases the container cannot be reclosed which means that the once opened container cannot be transported easily and that the contents of the container must be used up rapidly if it is not stable under the influence of the surrounding air.

Containers which do not show the above described disadvantages are e.g. equipped with closure units which are fitted over an opening in the container wall and which consist of a pouring part fixed to the container wall and a closure part removably closing the opening of the pouring part. Such equipped containers are very comfortable in use, but they are rather expensive regarding manufacturing. The closure unit is usually fitted to the container wall material before folding and welding it to form the container or at least before filling the container and it must satisfy the same hygienic and antiseptic standards as the inside surface of the container wall in order to allow long storage of the filled container.

For omitting the described disadvantages of containers with fitted closure units, combinations of containers of plastic coated cardboard with a potential opening and corresponding plug-in closure units have been designed. The combination is usually brought to the market with the plug-in closure unit attached to one side of the filled container, in the same way as drinking straws are attached to the container. The potential opening is a predetermined location on the containers, and is equipped such that it can be opened easily by the consumer by removing a stuck on pull tab and/or by breaking a predetermined breaking point in the container wall or at least in some of its layers when inserting the closure unit, thus forming an opening of a predetermined shape.

Such a plug-in closure unit has inner and outer retaining means and when it is positioned in the container opening, the edge of the container wall is retained between these retaining means.

Conditions to be satisfied by a combination of a container and a plug-in closure unit are the following:

- The potential opening in the container must be openable easily, but it must not be a weak point of the container such that the container with the potential opening can be handled in exactly the same way as a similar container without a potential opening or a container with a fitted closure unit.
- The closure unit must be fiat, such that it can be packed with the container without causing difficulties regarding transport and storage of the combination.
- The consumer must be able to plug in the closure unit into the potential opening with a reasonable amount of force and without deforming the container wall too much (especially important for containers which are completely filled).

- The plugged-in closure unit must be openable without coming off the container.
- The container with plugged-in closure unit must be tight regarding tightness between container and closure unit as well as regarding tightness between closure part and pouring part of the closure unit.
- If besides all the above named conditions, further conditions regarding easy pouring and clean reflux of the contents into the container after pouring can be satisfied, then the combination of container and closure unit is very advantageous. The same applies for conditions regarding prolonged service time of the container with plugged-in closure unit without deterioration.

In the publication EP-A2-291112 a combination of a container and a plug-in closure unit is described, which combination satisfies the above described conditions more or less. The closure unit of the described combination consists of a pouring part and a closure part connected by a hinge, which closure part features an opening lip positioned opposite the hinge and serves to open the closure unit. The above condition of the potential opening as well as the condition of the flatness of the closure unit are satisfied well, but for the sake of its flatness, the pouring characteristics of the closure unit are very poor and must be assisted by a protruding rim on the container.

The closure unit of the described combination is fitted to the container by positioning it on the opening and then pressing it into it with a force perpendicular to the container surface. There is a snap running all round the outside of the pouring part, serving as inner retaining means. The outermost edge of the snap circumscribes an area which corresponds to the container opening in shape, but is larger than it. The snap is meant to be pushed through the opening and to retain the pushed-in closure unit in the opening. On pushing the snap through the opening, the cardboard edge all round the container opening is stressed and at least temporarily deformed. For this reason the force necessary for inserting the closure unit into the opening is rather large. At the same time the whole container wall is being pressed towards the inside of the container, which might cause the contents to be spilled.

Positioning and insertion of the closure unit into the opening is facilitated by a conical sliding face leading up to the edge of the snap. The ease with which the closure unit can be inserted into the opening is determined by the steepness of this sliding face which determines also how deep the fitted pouring part extends into the inside of the container, and therefore also determines its flatness.

Opening characteristics and tightness of the known combination of container and plug-in closure unit are satisfactory, at least for only short service. If the container with inserted closure-unit is in use over a longer period of time, the liquid contents is sucked up by the cardboard in the region of its edge around the opening, where its coating is interrupted. This causes deterioration of the tightness between container and closure unit and does not look nice.

It is thus the object of the invention to create a combination of container and plug-in closure unit which satisfies all the above mentioned conditions and satisfies them better than the combination of container and closure unit according to the state of the art. It is further an object of the invention to show a method for manufacturing a container for the combination.

SUMMARY OF THE INVENTION

These objects are achieved by the combination of container and closure unit and the method according to the invention.

The basic idea of the invention is that, for minimizing the force necessary for insertion of the closure unit into the container opening and with this, minimizing the deformation of the container wall during insertion, the inner retaining means are adapted exactly to the function of the closure unit. This means, the inner retaining means are shaped such that they are not regularly spread round the outer circumference of the pouring part but are pronounced where, on opening and closing the closure unit, forces act on the pouring part and container, and are not present where no such forces act.

The force necessary for insertion of the closure unit in the opening is further reduced by shaping not the total of the inner retaining means as snaps but only a minimal part, whilst the rest is formed as retaining lip or lips not to be pressed into the opening but slid sideways under the edge of the opening thus minimizing the necessary deformation of this edge even further.

Furthermore the edge of the container opening is improved for a container of coated cardboard material by a continuous coating all round the cardboard edge. Such sucking up of liquid into the cardboard is prevented.

BRIEF DESCRIPTION OF THE DRAWINGS

The inventive combination of a container with potential opening and a plug-in closure unit is described in detail in connection with the following Figures, in which:

FIGS. 1 to 3 show the principle of the plug-in closure unit according to the state of the art in top view (FIG. 1) and in cross section (FIGS. 2 and 3);

DETAILED DESCRIPTION OF THE INVENTION

Figure 4:
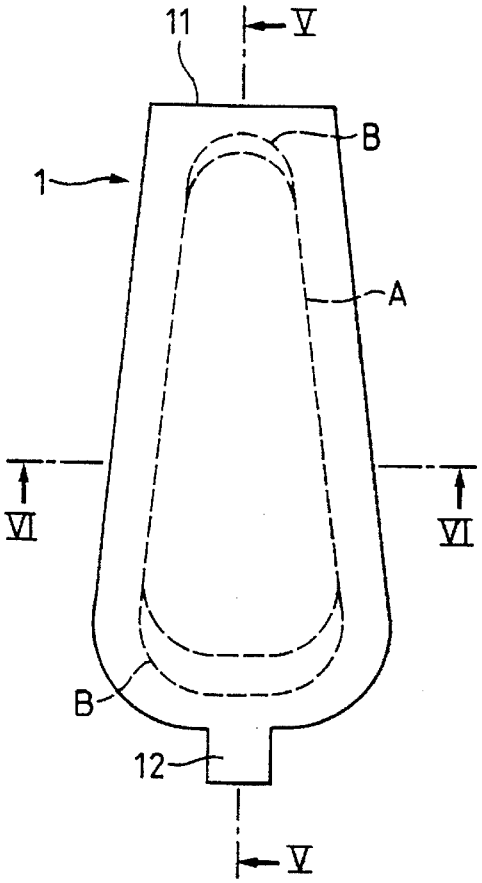
FIGS. 4 to 6 are views similar to FIGS. 1 and 3 showing the principle of the plug-in closure unit of the inventive combination.

The following description relates to combinations with containers of coated cardboard. This does not mean that the invention is limited to such containers. All containers with walls sufficiently flexible for introducing a closure unit can be part of an inventive combination of container and closure unit, e.g. containers of metal such as aluminium or sheet steel or containers of plastic.

FIGS. 1 to 3 show the principle of the plug-in closure unit (drawn in closed position) according to the state of the art. The closure unit is not drawn in all detail but only the essentials are shown. FIG. 1 shows the closure unit from the top. Only the outline of a closure part 1 with a hinge 11 and an opening lip 12 in positions opposite to each other are drawn, the trace of the edge of the container wall (interrupted line A) around the opening into which the closure unit is inserted and the trace of inner retaining means (interrupted line B) extending over this edge on the inside of the container are also shown. Lines A and B run substantially parallel.

The oblong shape of the container opening (and of the pouring opening in the pouring part of the closure unit) with the hinge and the opening lip separated by the largest expansion of this oblong shape is chosen for good pouring characteristics.

FIGS. 2 and 3 are cross sections through the closure unit according to FIG. 1, cut along section lines II—II (FIG. 2) and III—III (FIG. 3) indicated in FIG. 1, i.e. through hinge position and opening lip position (FIG. 2) and perpendicular to the latter (FIG. 3). They show the closure unit with pouring part 2 and closure part 1 being connected through hinge 11. The closure unit is inserted in an opening of the container wall 3. The pouring part 2 has a neck 21 around which the edge 31 of the container wall 3 fits tightly. The pouring part further has inner retaining means in the form of a snap 22 extending on the inside of the container over the opening. The snap 22 is formed by a sliding face 23, a snap edge 24 (line B in FIG. 1) and an inner retaining face 25 leading to the neck 21. The area circumscribed by the snap edge 24 is larger than the opening, the area circumscribed by the opposite edge of the sliding face 23 (opposite the snap edge 24) is smaller than the opening. The pouring part has outer retaining means also which extend over the container wall opening. As these do not influence the insertion characteristics of the closure unit, they need not be described in detail. Inner retaining face 25 and outer retaining means define together the position of the container wall 3 relative to the pouring part (inner and outer retaining planes C and C').

Usually the opening in the container wall before insertion of the closure unit is slightly smaller than the circumference of the neck 21, such that the cardboard edge 31 is pressed against the neck 21 of the inserted closure unit in a tight fit.

A comparison of FIGS. 2 and 3 as well as lines A and B in FIG. 1 show that the inner retaining means of the closure unit according to the state of the art have the same shape all around the pouring part. The closure unit is inserted in the container opening by positioning the innermost edge of the sliding face into the opening and then pressing the closure unit into the opening with a force applied substantially in the center of the closure unit and substantially perpendicular to the container wall.

Figure 5:
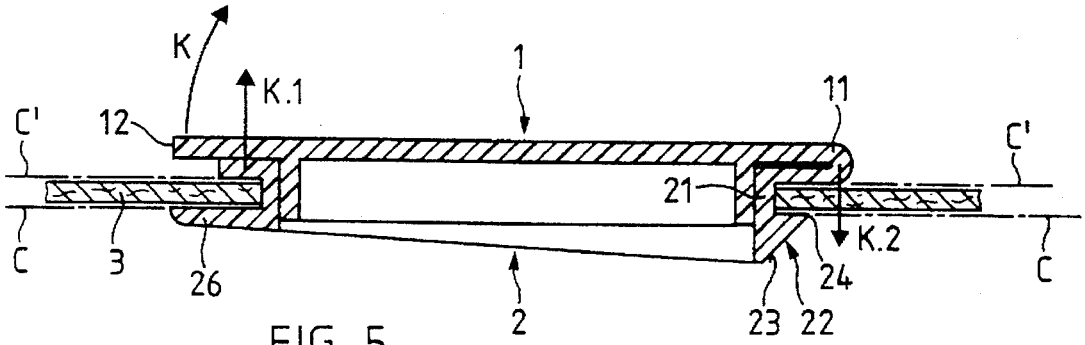
Figure 6:
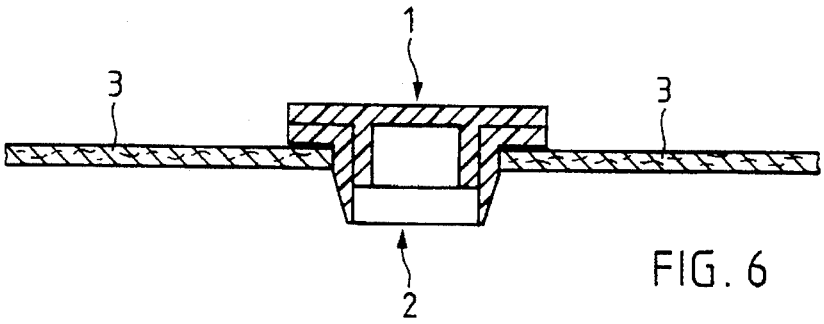

FIGS. 4 to 6 show the closure unit of the inventive combination in the same way as FIGS. 4 to 6 show the closure unit according to the state of the art. Same items are identified with same numerals. The main feature of the closure unit according to FIGS. 4 to 6 concerns the inner retaining means, which are provided only in the hinge position and the opening lip position of the opening. This means that the pouring part of the inserted closure unit extends over the opening only in the position of the hinge and in the position of the opening lip. This is obvious from lines A (container wall edge) and B (retaining means extending over opening) of FIG. 4. It is also obvious from a comparison of FIG. 5 in which parts (inner retaining means) of the pouring part 2 extend over the container wall opening on the inside of the container, and FIG. 6 in which no parts of the pouring part extend over the container wall opening on the inside of the container.

Considering the function of the closure unit, it is fully sufficient to fit inner retaining means only in two positions, namely in the hinge position and in the opening lip position opposite to the hinge position. When the closure unit is opened with an opening force K applied to the opening lip 12, then a force K.1 pulling the closure unit out of the pouring opening acts in the region of the opening lip 12, a force K.2 pressing the closure unit into the opening acts in the region of the hinge 11, force K.1 and K.2 being of the same order of magnitude. When the closure unit is closed, forces K, K.1 and K.2 are reversed, if the closing force is applied to the opening lip 12 only. This is usually not the case as the closure part of the closure unit is more comfortably pressed down in its center, which results in forces in the hinge position and in the opening lip position both pressing the closure unit into the opening. For all the described cases of opening and closing the closure unit, no forces pulling the closure unit out of the opening and being worth considering act in positions between the hinge and the opening lip position, i.e. in the area of section line VI—VI (FIG. 4). Thus, in the areas mentioned above inner retaining means are not necessary.

From the above consideration of the forces acting on the inserted closure unit on opening and closing it, it is advantageous to fit the stronger retaining means in the opening lip position. This is shown in FIG. 5 with a retaining lip 26 in the opening lip position and a snap 22 in the hinge position. The retaining lip 26 differs from the snap 22 by the larger extension over the container wall opening and by the lack of a sliding face. A closure unit with a retaining lip 26 and a snap 22 is fitted into the opening by first sliding the retaining lip 26 under the container wall edge and then pressing the snap 22 into the opening. As the snap 22 is only narrow (regarding its expansion parallel to the container wall), this way of insertion only needs a small pressing force and therefore only leads to a small deformation of the container wall such that spilling of the contents can be prevented. The sliding face is therefore a slanted surface on snap 22 configured such that it allows the snap to be pressed onto the hinge position into the opening, so that the edge of the opening slides on the sliding face before fitting into neck 21 as shown in FIG. 5.

The different shaping of the inner retaining means in opening lip and hinge position is not an obligatory feature of the closure unit of the inventive combination. The inner retaining mean in both positions may also be shaped as snaps.

The closure unit according to FIGS. 4 to 6 has good pouring characteristics if its pouring opening and the opening in the container wall are shaped to be oblong as drawn in FIGS. 1 to 6, but other shapes of openings are possible also, e.g. round openings.

Figure 7:
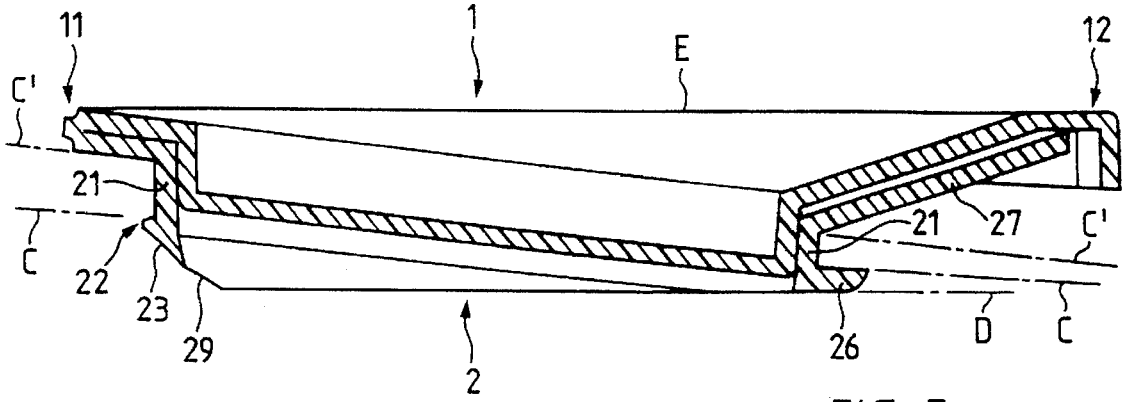
FIGS. 7 and 8 show an exemplified embodiment of a closure unit for an inventive combination in cross section and in a perspective view.
Figure 8:
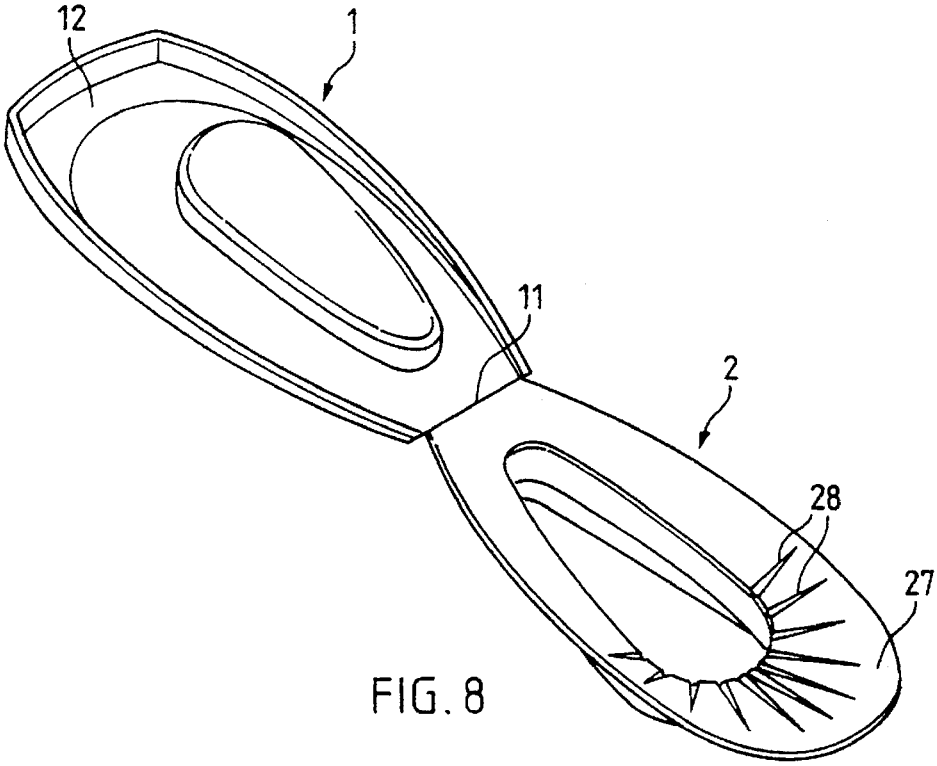

FIGS. 7 and 8 show in detail an exemplified embodiment of a plug-in closure unit, in which the principles according to FIGS. 4 to 6 are applied and carried further to achieve more advantageous features.

FIG. 7 shows the closed closure unit in a cross-sectional view similar to FIG. 5 showing closure part 1 and pouring part 2. The inner retaining means are realized as retaining lip 26 and snap 22 with sliding face 23, which inner retaining means define the inner retaining plane C.

The pouring part has outer retaining means also, which define the outer retaining plane C'. It is advantageous to shape the outer retaining means such that the inner and the outer retaining plane C and C' are not parallel, such that the neck 21 is higher in the hinge (snap) position than in the opening lip (retaining lip) position and can therefore accommodate a more deformed container wall edge. With a neck formed as described above, the position of the inserted closure unit is defined satisfactorily and still it is not possible that the deformed edge of the container wall covers the snap which would impair the tightness between neck and container wall edge in the area of the snap.

As for the retaining lip 26 no sliding face is needed, the pouring part extends into the container much less in the opening lip position than in the hinge position, i.e. plane D to which the pouring part extends is not parallel to the inner retaining plane C, i.e. not parallel to the container wall. This means that without increasing the maximum expansion of the pouring part perpendicular to the container wall, it can be equipped with a pouring lip 27 in this position which pouring lip decreases in height above the container wall in the direction toward the hinge position. Such a pouring lip improves the pouring characteristics of the closure unit considerably. It is advantageous to shape pouring part 2 and closure part 1 such that the closed closure unit extends on the outside of the container to a plane E which is parallel to plane D and positioning the hinge 11 substantially parallel to the intersection line of the outer retaining plane C' and plane E (see FIG. 8).

FIG. 8 further illustrates the closure unit according to FIG. 7, shown in an open state, viewed from the top (from a region outside of the container). Same parts are designated with same numerals as in the preceding Figures. FIG. 8 does not need further explanation.

The closure unit for the inventive combination of container and closure unit consists advantageously of a thermoplastic material and is produced in an injection moulding process. Hinge 11 is realized as a thin and therefore flexible area, as a so called film hinge. The inside of the pouring lip 27 may be equipped with channels 28 which facilitate the reflux into the container of liquid remains after pouring. The sliding face 23 of the snap may be interrupted to form an airing opening 29 (FIG. 7) which facilitates even pouring.

Figure 9:
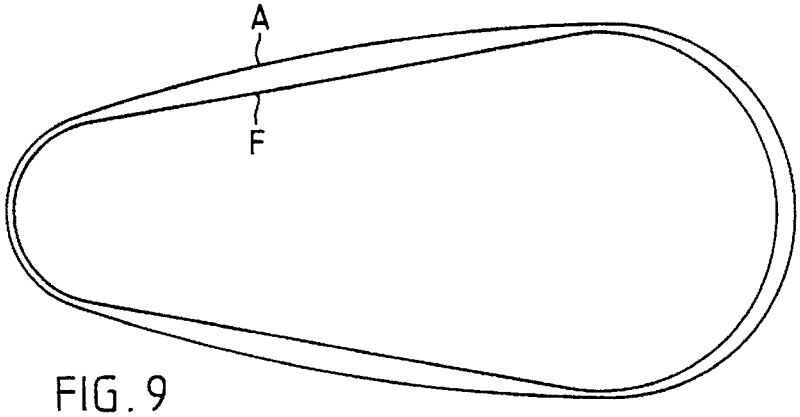
FIG. 9 shows the neck cross section of the closure unit according to FIGS. 7 and 8 and the container opening of the corresponding container.

FIG. 9 shows projected over each other the contour of the neck cross section A and the potential opening F in the container before insertion of the closure unit. The opening is basically smaller than the neck cross section. In this way the container wall edge is pressed against the neck of the inserted closure unit guaranteeing a tight fit. The two contours A and F are not parallel to each other. Whereas the the opening shape (line F) consists of two arcs having different radii and two straight lines, the neck contour consists only of arcs having different radii. This shaping of the neck is advantageous since areas of the neck contour corresponding to a transition between an arc and a straight line cause more stressing of the container wall edge than other areas and are therefore advantageously omitted. The difference in size of the neck contour and the container wall opening is a function of the quality of the container wall. The drawing in FIG. 9 shows an opening having a length of of 21 mm in a container of coated cardboard with a capacity of 250 ml (FIG. 9 corresponding to a magnification of about 1:6.4).

Further to the inventive improvements of the closure unit, improvements are proposed for the opening in the container wall, in particular for containers made of coated cardboard.

Figure 10:
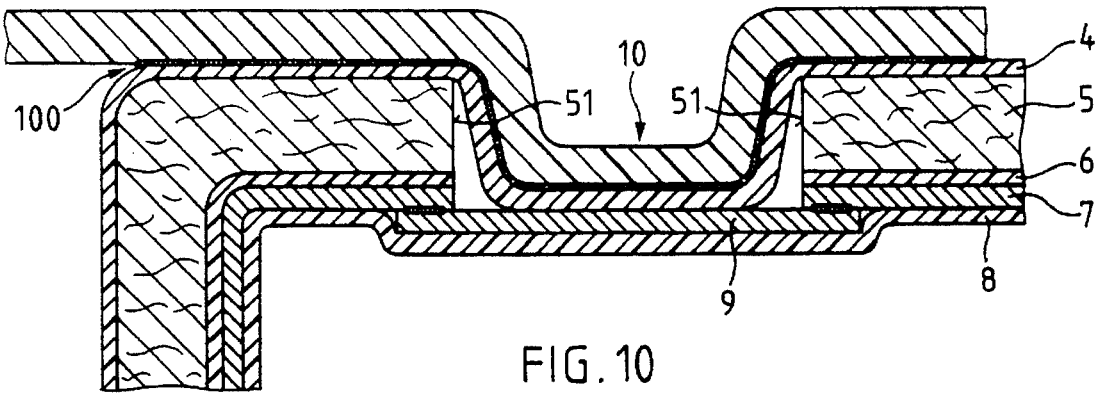
FIG. 10 shows a cross section through a container wall of coated cardboard with a potential opening according to the state of the art.

FIG. 10 shows a cross section through such a container wall in the area of a potential opening, as known from containers of coated cardboard material. The wall material is a laminated material and consists e.g of five layers: outer coating 4, cardboard 5, intermediate layer 6, gas and aroma barrier layer 7 and inner coating 8. The cardboard layer 5 gives the material the necessary mechanical strength. Inner and outer coating 4 and 8 usually consist of polyethylene and make the cardboard liquid-tight. The gas and aroma barrier layer 7 consists of e.g. aluminium and is fixed to the cardboard 5 via an intermediate layer 6 (e.g. polyethylene). Layers 6 and 7 are optional.

The potential opening (that is, the opening provided in the container wall closed by one or more closure elements) according to the state of the art is produced by punching an opening into the cardboard (layer 5, or layers 5, 6 and 7) before laminating it with the outer (4) and inner (8) coating layers. Between punching the opening and lamination of the inner and outer coating, usually a closure element in the form of a piece of foil 9 (e.g. Aluminum foil) is welded across the inside of the opening. After lamination of the inner and outer coating, a pull tab 10 is fitted on the outside of the potential opening by welding it onto the outer coating 4 (weld 100). Usually the opening is positioned in the area of a container edge. Pull tab 10 extends over the edge and weld 100 does not continue round the edge such that the end of the pull tab can be gripped for pulling the pull tab off the opening.

For inserting a closure unit, the pull tab 10 is pulled off, tearing off with it parts of the outer coating 4, part of the inner coating 8 and aluminium foil 9. It is obvious that by doing so, the cardboard edge 51 gets exposed, in particular to the contents of the container, and in case of liquid contents gets wet and deteriorates.

Figure 11:
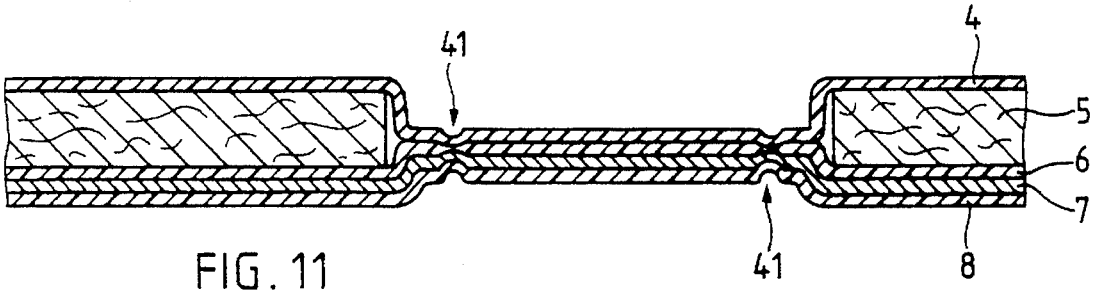
FIG. 11 shows an exemplified embodiment of a container wall with potential opening for a combination according to the invention.

FIG. 11 shows an improved container wall material with a potential opening. It consist again of the already described layers 4 to 8. A first opening is punched into the cardboard layer 5. All the other layers (4, 6, 7, 8) are laminated across this first opening as closure elements and therefore adhere to each other as well as to the laminated layers of the material where there is no opening. Then the layers across the opening are imprinted such that a weakened line 41 running inside the first opening and substantially parallel to the cardboard edge is formed, circumscribing a potential second opening which is smaller than the first opening in the cardboard layer 5. The potential second opening is opened by breaking along the weakened line 41 the layers across the opening when inserting a closure unit. Because the layers across the first opening adhere to each other and because the potential opening defined by the weakened line 41 is smaller than the first opening in the cardboard, the cardboard edge stays covered by at least one coating when the potential opening is opened up and therefore no liquid can be sucked up by this cardboard edge.

Figure 12:
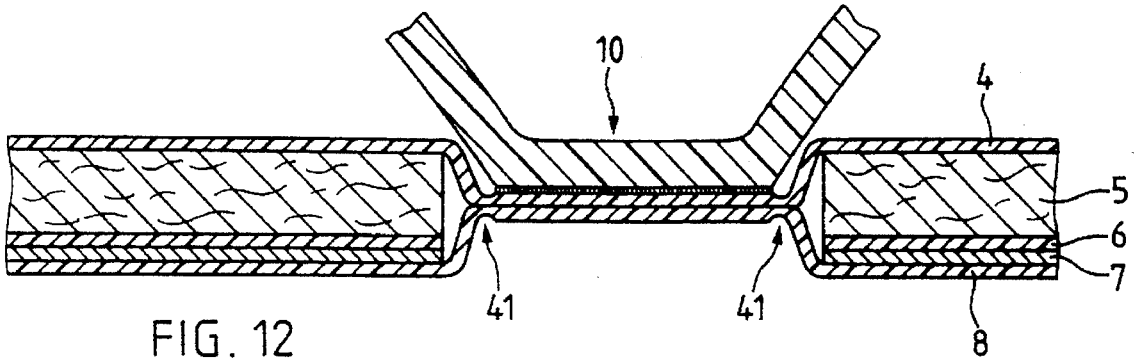
FIGS. 12 to 14 show cross sections through further embodiments of container walls with potential openings.

FIG. 12 shows a further embodiment of a container wall with potential opening. The wall material is the same as in FIGS. 10 and 11 (layers 4 to 8). A first opening is punched into layers 5 to 7, then coatings 4 and 8 are laminated to the material and then a weakened line 41 is imprinted, defining a potential opening which is smaller than the first opening in the cardboard layer 5. The potential opening is covered with a pull tab 10 for reinforcing it. It must be made sure that the pull tab 10 is only welded to the outer coating 4 within the weakened line 41. When pulling off the pull tab 10, coatings 4 and 8 are broken along the weakened line 41 and the piece inside this line is removed with the pull tab.

Figure 13:
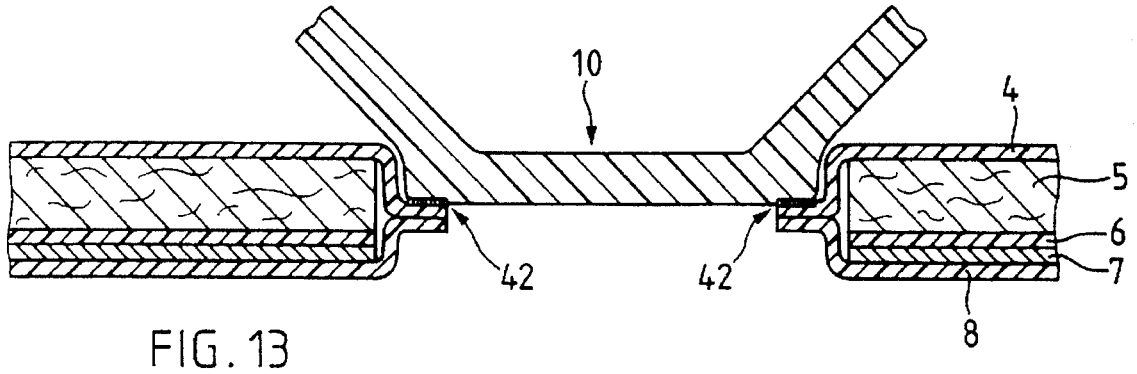

FIG. 13 shows a further embodiment of a container wall with potential opening. The potential opening in the container wall is made by punching a first opening into the cardboard, laminating further layers across the first opening, punching a second opening (smaller than the first opening) and reclosing it with a pull tab 10, which is welded to the outer coating 4 in the region of its edge around the second opening. For this embodiment it must be made sure that the fastening of the pull tab 10 around the opening is weaker than the adherence between the coatings 4 and 8, since only in the above condition can one make sure that upon pulling the pull tab 10 neither coatings 4 and 8 nor their fastening are damaged, exposing the cardboard edge. This can e.g. be realized by making the pull tab or at least the one layer of the pull tab, which is to face the container wall, of aluminium, which adheres to coating 4 of polyethylene less well than polyethylene on polyethylene (coating 4 on coating 8).

Figure 14:
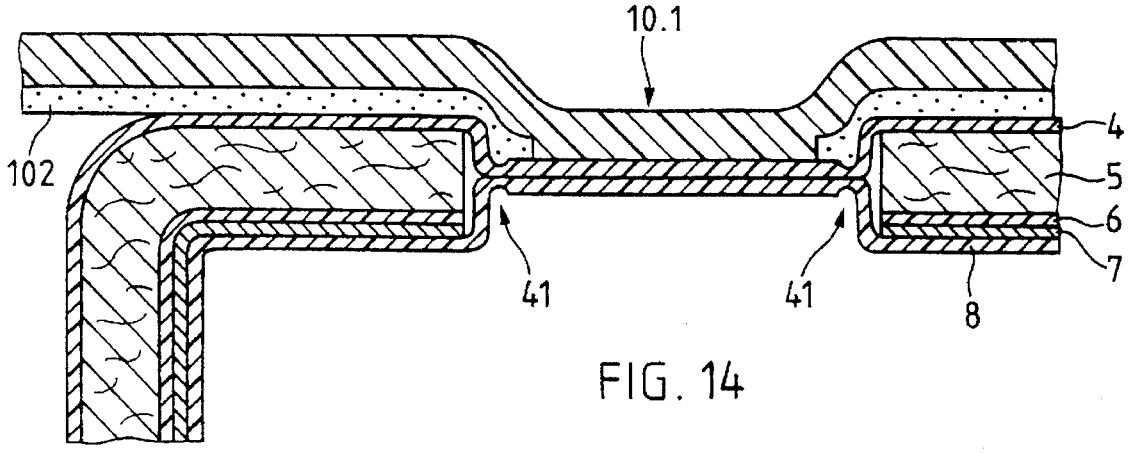

FIG. 14 shows a further way of fixing a pull tab 10.1 on a potential opening, e.g. on a potential opening as described already in connection with FIG. 12. The pull tab 10.1 carries as its outermost layers turned towards the container wall a peel foil 102 whose characteristic it is to adhere to the outer coating 4 even after welding only such that it can be peeled off. The peel foil 102 shows an opening in a central position of the pull tab, which opening is smaller than the potential opening in the container wall material. The pull tab 10.1 is fixed to the potential second opening such that the opening in the peel foil lies inside the weakened line 41, e.g. by welding. Such a pull tab is peeled off the container tearing off with it in the area of the peel foil opening coatings 4 and 8 by breaking them along the weakened line 41. The cardboard edges around the opening stay covered by the coating layers 4 and 8.

Features of the embodiments according to FIGS. 11 to 14 can be differently combined also. The described improvements regarding a potential opening in a container wall are not only advantageous for laminated wall material containing a cardboard layer but generally for such materials containing one layer of a material being sensitive to the contents of the container or having a negative influence on this contents. Using the described potential opening, direct contact between this layer and the contents is prevented.

What is claimed is:

1. A combination of a container and a plug-in closure unit, the container having an interior, an exterior, a wall and an oblong opening in the wall, the opening having a width and a length longer than its width and further defining an edge, the closure unit being adapted to be inserted into the opening, the closure unit further having a closed state and an open state and comprising:

a closure part including an opening lip defining an opening lip region;

a hinge disposed opposite the opening lip of the closure part and defining a hinge region; and a pouring part connected to the closure part by the hinge, the pouring part including:

an oblong neck adapted to be retained in the opening of the container, the neck having a width and a length longer than its width and further being configured such that an area circumscribed by a circumference of the neck is larger than an area circumscribed by the edge of the opening, wherein a difference between the widths of the opening and the neck is larger than a difference between the lengths of the opening and the neck;

a pouring opening operatively associated with the neck, the closure part being adapted to tightly close the pouring opening by fitting thereupon and further being adapted to open the pouring opening by being removed therefrom for placing the closure unit in its closed state and in its open state, respectively;

an inner retaining means for retaining the neck in the opening by extending beyond the edge of the opening on the interior of the container when the closure unit is inserted into the opening thereby defining an inner retaining plane C, the inner retaining means consisting of:

a first inner retaining means disposed exclusively in the hinge region when the closure unit is inserted into the opening; and a second inner retaining means disposed exclusively in the opening lip region when the closure unit is inserted into the opening; and an outer retaining means for retaining the neck in the opening by extending beyond the edge of the opening on the exterior of the container when the closure unit is inserted into the opening, the outer retaining means thereby defining an outer retaining plane C', a portion of the wall of the container being adapted to be retained between the inner retaining means and the outer retaining means between planes C and C'.

2. The combination according to claim 1, wherein:

the first inner retaining means is a snap element having a sliding face adapted to slide into the opening when the closure unit is being inserted therein; and the second inner retaining means is a retaining lip which does not include a sliding face.

3. The combination according to claim 1, wherein:

the contour defined by the edge of the opening includes linear portions; and portions of the contour defined by the circumference of the neck which are disposed adjacent the linear portions of the opening when the closure unit is inserted into the opening are arched.

4. The combination according to claim 1, wherein in its closed state, the closure unit defines an outer plane E on a top surface of its closure part and an inner plane D on a bottom surface of the pouring part, planes E and D being substantially parallel with respect to one another, the inner retaining plane C and the outer retaining plane C' being disposed at an angle with respect to planes E and D.

5. The combination according to claim 4, wherein the inner retaining plane C is at an angle with respect to the outer retaining plane C' such that the neck has a larger height in the hinge region than in the open lip region.

6. The combination according to claim 4, wherein the pouring part further includes a pouring lip disposed in a region between the outer retaining plane C' and the outer plane D in the opening lip region, the pouring lip extending higher than the hinge above the outer retaining plane C'.

7. The combination according to claim 6, wherein the pouring lip has an inner region including reflux channels.

8. The combination according to claim 1, wherein the opening in the wall of the container is a second opening, the wall of the container comprising:

a core layer having an inner side and an outer side, the core layer defining a first opening therein having an edge; and a plurality of coatings laminated onto the core layer and defining the second opening, the second opening being smaller than and disposed in registration with the first opening, the plurality of coatings being fastened together at a location between the edge of the first opening and the edge of the second opening and including:

an inner coating laminated onto the inner side of the core layer; and an outer coating laminated onto the outer side of the core layer.

9. The combination according to claim 8, wherein the core layer consists of cardboard, and the inner coating and the outer coating consist of polyethylene.

10. The combination according to claim 8, wherein the second opening is a potential opening, the inner coating and the outer coating extending across the first opening and defining a weakened line running substantially parallel to the edge of the first opening, the weakened line thereby defining the edge of the second opening.

11. The combination according to claim 10, further comprising a pull tab fastened over the second opening on the outer coating.

12. The combination according to claim 11, wherein the pull tab adheres only to a region of the outer coating disposed inside the weakened line.

13. The combination according to claim 11, further comprising a peel foil disposed between the pull tab and the outer coating, the peel foil defining a third opening therein disposed in registration with the second opening.

14. The combination according to claim 8, wherein the second opening is a reclosed opening, the inner coating and the outer coating stopping short of extending across the first opening thereby defining the edge of the reclosed opening, the combination further comprising a pull tab fastened on the outer coating thereby reclosing the reclosed opening.

15. A combination of a container and a plug-in closure unit, the container having an interior, an exterior, a wall and an opening in the wall, the opening defining an edge, the closure unit being adapted to be inserted into the opening, the closure unit further having a closed state and an open state and comprising:

a closure part including an opening lip defining an opening lip region;

a hinge disposed opposite the opening lip of the closure part and defining a hinge region; and a pouring part connected to the closure part by the hinge, the pouring part including:

a neck adapted to be retained in the opening of the container, the neck being configured such that:

an area circumscribed by a circumference of the neck is larger than an area circumscribed by the edge of the opening; and a contour defined by the circumference of the neck does not correspond in shape to a contour defined by the edge of the opening, wherein the contour defined by the edge of the opening includes linear portions, and portions of the contour defined by the circumference of the neck which are disposed adjacent the linear portions of the opening when the closure unit is inserted into the opening are arched;

a pouring opening operatively associated with the neck, the closure part being adapted to tightly close the pouring opening by fitting thereupon and further being adapted to open the pouring opening by being removed therefrom for placing the closure unit in its closed state and in its open state, respectively;

an inner retaining means for retaining the neck in the opening by extending beyond the edge of the opening on the interior of the container when the closure unit is inserted into the opening thereby defining an inner retaining plane C, the inner retaining means consisting of:

a first inner retaining means disposed exclusively in the hinge region when the closure unit is inserted into the opening; and a second inner retaining means disposed exclusively in the opening lip region when the closure unit is inserted into the opening; and an outer retaining means for retaining the neck in the opening by extending beyond the edge of the opening on the exterior of the container when the closure unit is inserted into the opening, the outer retaining means thereby defining an outer retaining plane C', a portion of the wall of the container being adapted to be retained between the inner retaining means and the outer retaining means between planes C and C'.

* * * * *